US005980959A

United States Patent [19]

Frutin

[11] Patent Number: 5,980,959

[45] Date of Patent: Nov. 9, 1999

[54] METHODS AND APPARATUS FOR ENHANCING BEVERAGES

[76] Inventor: Bernard Derek Frutin, 'Jaapston', By Uplawmoor, Renfrewshire, G78 3B1, Scotland, United Kingdom

[21] Appl. No.: 08/628,624

[22] PCT Filed: Oct. 12, 1994

[86] PCT No.: PCT/GB94/02220

§ 371 Date: May 8, 1996

§ 102(e) Date: May 8, 1996

[87] PCT Pub. No.: WO95/10479

PCT Pub. Date: Apr. 20, 1995

[30] Foreign Application Priority Data

| | | | |
|---|---|---|---|
| Oct. 12, 1993 | [GB] | United Kingdom | 9321042 |
| Jan. 11, 1994 | [GB] | United Kingdom | 9400420 |
| Jan. 11, 1994 | [GB] | United Kingdom | 9400421 |

[51] Int. Cl.[6] ..... B65B 31/00; B65B 17/00; B65B 25/00

[52] U.S. Cl. ..... 426/112; 426/115; 426/118; 426/124; 206/222; 53/420; 220/501

[58] Field of Search ..... 426/112, 115, 426/118, 120, 124, 569, 394, 395, 397, 477; 99/323.1, 323.2; 206/222; 261/DIG. 7; 53/420; 220/501

[56] References Cited

U.S. PATENT DOCUMENTS

| | | | |
|---|---|---|---|
| 2,073,273 | 3/1937 | Wetstein | 99/323.2 |
| 2,220,146 | 11/1940 | Curry | 220/583 |
| 2,631,521 | 3/1953 | Atkins, Jr. | 99/275 |
| 3,305,368 | 2/1967 | Bourelle | 426/120 |
| 3,480,403 | 11/1969 | Hovey | 422/238 |
| 4,333,581 | 6/1982 | Flansburg | 220/20 |
| 5,290,574 | 3/1994 | Jameson et al. | 426/112 |

FOREIGN PATENT DOCUMENTS

| | | |
|---|---|---|
| 54297 | 10/1974 | Australia . |
| 0 008 886 | 3/1980 | European Pat. Off. . |
| 0 235 063 | 9/1987 | European Pat. Off. . |
| 0 518 522 | 12/1992 | European Pat. Off. . |
| 28272 | 7/1883 | Germany . |
| 280762 | 7/1913 | Germany . |
| 2 273 917 | 7/1994 | United Kingdom . |
| 91/07326 | 5/1991 | WIPO . |
| 9113007 | 9/1991 | WIPO . |

*Primary Examiner*—Curtis E. Sherrer
*Attorney, Agent, or Firm*—Alston & Bird LLP

[57] ABSTRACT

Enhancing the foam head on a bottled beverage where a pressurized container is housed within the neck of the bottle and above the level of the liquid and so arranged that upon opening of the bottle the pressurized container also opens to release the liquid stream therefrom initially to float on the top surface of the beverage in the bottle.

4 Claims, 3 Drawing Sheets

METHODS AND APPARATUS FOR ENHANCING BEVERAGES

BACKGROUND OF THE INVENTION

This invention relates to methods and apparatus for enhancing the foam based on a glass of beverage.

This invention particularly relates to beverages that are dispensed into drinking vessels and which in this process are provided with foam heads formed by release of gases contained in solution in the beverage prior to dispensing. The beverage may contain alcohol such as is found in dark or light beers and lagers or may be wholly or substantially alcohol free such as in carbonate soft drinks like ginger or other root beers, lemonade and the like or the so-called low alcohol beers.

The beverage may be dispensed by drawing from a bulk store such as a barrel or may be dispensed by emptying from individual containers such as a can or bottle containing a measured quantity of the beverage.

It is highly desirable, particularly for beers, to provide a dense foam head to the dispensed beverage in the drinking vessel, which head will be retained for long periods even during consumption of the liquid portion of the beverage, because the consumer relates foam or head retention and head density or quality to a high quality beverage.

The present invention is concerned with new and improved methods of and apparatus for enhancing foam heads on beverages.

SUMMARY OF THE INVENTION

In accordance with one aspect of the present invention there is provided a method of enhancing the foam head on a volume of dispensed beverage containing a gas in solution, which method comprises injecting a liquid stream into the dispensed beverage, the liquid stream comprising a liquid containing a suitable gas in super-saturated solution therein.

The liquid stream may be introduced to the dispensed beverage above the surface level of the dispensed beverage or below that surface and within the body of the dispensed beverage.

The gas is preferably contained in saturated solution in a suitable liquid and at elevated pressure prior to the liquid stream being formed, so that the liquid stream will become at least temporarily super-saturated as it is injected into the dispensed beverage, and it co-operates with the gas content of the dispensed beverage in a form of seeding effect to achieve an enhanced foam head without major depletion of the gas content of the dispensed beverage which therefore remains gasified.

The liquid stream may be added in a predetermined amount by volume or weight (a metered dose) in relation to the volume of the dispensed beverage but metering is not a critical factor and the gasified liquid stream may be added to the dispensed beverage on more than one occasion in order to achieve a desired level of enhancement to the head. Furthermore, as the beverage is consumed one or more metered doses may be applied to the beverage to rejuvenate the head.

The liquid phase of the liquid stream may for example be Manucol® adginate, or any food-grade surfactant, or water (e.g. Tap or De-ionised water) and it may contain dissolved gases such as carbon dioxide or nitrogen or a mixture thereof. Other gases as are well known in existing beverages may also be used in the liquid stream. It is however preferred that the dominant dissolved gas is nitrogen since this gives best results. The liquid phase of the gasified liquid stream may also be the same as the liquid phase of the beverage (e.g. bear) but in any event requires to be potable and compatible with the beverage.

In accordance with another aspect of the present invention there is provided a pressurised container containing a liquid having a gas dissolved therein substantially up to its solubility limit in the liquid at elevated pressure and ambient temperature, the container comprising a dispenser head and a valve mechanism which is operable to communicate the contents of the container to the dispenser head, the arrangement being such that the contents can be dispensed, onto or into a dispensed beverage, at ambient temperature and pressure as a liquid stream (as distinct from a spray) containing a saturated or super-saturated solution of dissolved gas therein.

Furthermore, acceptable results are also achieved when the liquid stream is in the form of a spray or mist and is dispensed into the drinking vessel prior to the beverage being disposed thereinto.

Accordingly in accordance with a further aspect the present invention provides a method of enhancing the foam head on a volume of dispensed beverage containing a gas in solution, which method comprises dispensing a liquid stream in the form of a spray or mist into the drinking vessel prior to the beverage being dispensed thereinto, the liquid stream comprising a liquid containing a suitable gas in super-saturated solution therein.

The gas is preferably contained in saturated solution in a suitable liquid and at elevated pressure prior to the liquid stream being formed, so that the liquid stream will become at least temporarily super-saturated as it is dispensed and it co-operates with the gas content of the subsequentially dispensed beverage in a form of seeding effect to achieve an enhanced foam head with major depletion of the gas content of the dispensed beverage.

The liquid stream may be dispensed in a predetermined amount by volume or weight (a metered dose) in relation to the volume of the dispensed beverage but, within limits, metering is not a critical factor. The liquid phase of the liquid stream may be as previously explained.

In accordance with a still further aspect of the present invention there is provided a method of enhancing the foam head on a volume of dispensed beverage containing a gas in solution, which method comprises dispensing onto the upper surface of the beverage in its container prior to the dispensing procedure a liquid stream comprising a liquid containing a suitable gas in super-saturated solution therein.

The gas is preferably contained in saturated solution in a suitable liquid and at elevated pressure prior to the liquid stream being formed so that the liquid stream will become at least temporarily super-saturated as it is dispensed. Also, the liquid stream is of lesser density than the beverage so that it is dispensed onto the surface of the beverage. During the subsequent dispensing procedure of the beverage and the liquid stream into a drinking vessel the liquid stream co-operates with the gas content of the beverage in a form of seeding effect to achieve an enhanced foam head in the drinking vessel with major depletion of the gas content of the beverage.

The liquid stream may be added in a predetermined amount by volume or weight (a metered dose) in relation to a volume of the beverage but, within limits, metering is not a critical factor. The liquid phase of the liquid stream may be as previously explained.

In accordance with a still further aspect of the present invention there is provided a bottle of potable beverage, the bottle top being sealed by a releasable closure, wherein the improvement is the provision of a pressurised container containing a liquid having a gas dissolved therein substantially up to its solubility limit in the liquid at elevated pressure and ambient temperature, which container is fitted within the neck of the bottle and is adapted on release of the bottle closure automatically to release its contents as a liquid stream containing a saturated or super-saturated solution of dissolved gas therein, the released liquid stream being directed towards the interior of the bottle and the upper surface of the beverage contained therein.

BRIEF DESCRIPTION OF THE DRAWINGS

Embodiments of the present invention will now be described by way of example with reference to the accompanying schematic drawings, in which.

DETAILED DESCRIPTION

Figure 1:
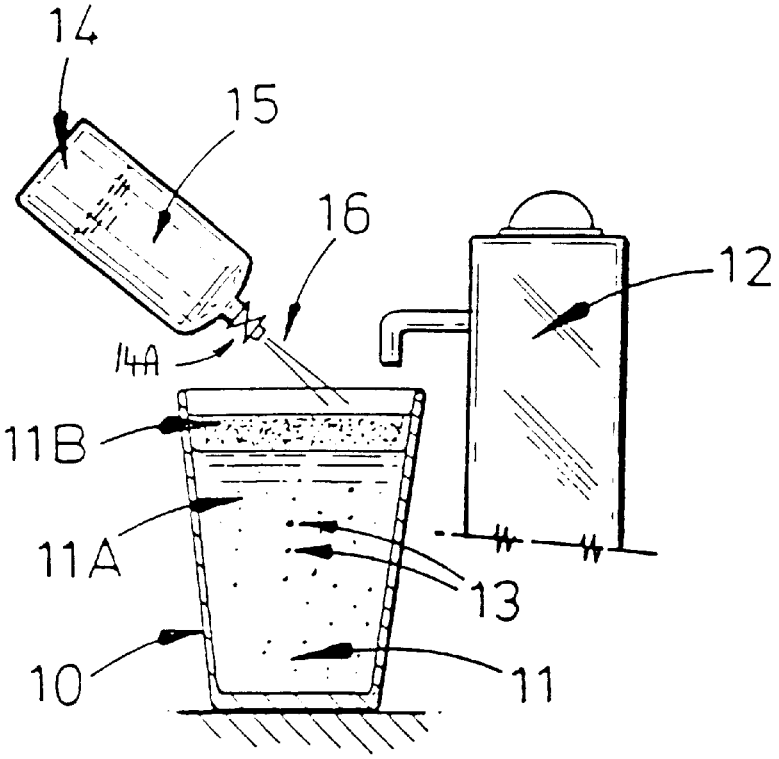
FIG. 1 illustrates a first aspect of the present invention.

The drawings show in FIG. 1 a glass 10 containing a measured quantity of beer 11 which has been dispensed at ambient temperature from a conventional beer font 12. The font 12 connects to and controls release of beer from a bulk store or barrel where the beer is stored under pressure. The beer 11 consists of a gasified liquid phase 11A surmounted by a foam or creamy head 11B which arises naturally from movement of small bubbles 13 emergent from the gasified liquid phase 11A during the dispensing procedure due to the release of pressure on the gasified liquid phase 11A.

A pressurised container 14 which may be hand held contains a liquid beer 15 having a gas in saturated condition dissolved therein at the elevated pressure prevailing within the container 14. The container 14 has a dispenser head 14A which incorporates a valve mechanism of the Tilt or Button type and which is manually operable such that when the valve is opened the contents of the container are communicated to the dispenser head 14A substantially without restriction and are dispensed therefrom at ambient temperature and pressure as a liquid stream 16 (as distinct from a spray) containing a super-saturated solution of the dissolved gas. The liquid stream 16 is directed or injected as a liquid jet into the beer 11. As illustrated, the liquid steam 16 impinges upon the upper surface of the beer 11 but dispenser head 14A may be provided at its outlet with a tube or the like of sufficient length to enter into the liquid phase 11A of the beer 11 so that the stream 16 occurs within the liquid phase 11A. Stream 16 is itself a mixture of beer and dissolved nitrogen gas, and on entering the liquid phase 11A of beer 11 gives rise to enhancement of the head 11B due to the release of the nitrogen gas contained in stream 16 and without significant depletion of the gaseous content of liquid phase 11A.

The container 14 may be dimensioned to provide for delivery of a single metered shot or dose of stream 16 to glass 10, for example the shot having a volume of the order of 0.2 to 5 ml. Alternatively the container 14 may be dimensioned to provide for a plurality of metered deliveries either to the same glass 10 or to a number of different glasses. In particular, it should be noted that the container 14 may be replenishable. For example it could be supplied intermittently with liquid beer by way of a T-piece from the main flow line of a draught beer dispensing system, and with nitrogen gas from a highly pressurised bulk source thereof. Although in the above described embodiment, the liquid stream 16 is beer containing dissolved gaseous nitrogen, the stream 16 can combine alternative constituents. For example, the liquid may be Manucol® adginate or other surfactant suitable for use in the brewing industry or tap or de-ionised water and the gaseous content of container 14 may be suitable gases other than nitrogen gas, for example compressed air or one of the other gases which are known for use in beers. In any event both the liquid content and the gaseous content of container 14 require to be compatible with beer 11 since both will be consumed by the consumer and of course it is undesirable to alter the taste of the beer 11 an any way.

Although the foregoing description refers to glass 10 containing beer 11 it is to be understood that any other form of potable beverage on which an enhanced foam head is desired may be contained in the glass 10, the beverage being of the type which contains a gas in solution.

Various tests have been carried out to inject liquid streams under various conditions into dispensed beverages and the results of these tests are shown in tabulated form in Tables I to V.

As regards Tables I–IV in each case the dispensed beverage was a fermented alcoholic beverage sold under the tradename BASS DRAUGHT ALE taken from a standard 440 ml can and poured at +5° C. carefully so as to have no head into a standard 1 pint glass so that delivery of the liquid stream was into a beer with no head. The liquid stream in Tables I and II was taken from a container (14) which had been partly filled with BASS DRAUGHT ALE fermented beverage and the remaining volume of the container was filled with Nitrogen gas at 5° C. pressurised to 70 psig. The containers (14) used for the tests of Tables I and III were provided with tilt valves of the type sold under the tradename COSTER TILT VALVES whereas the containers (14) used for the tests of Tables II and IV were provided with button valves sold under the name PERFECT-VALOIS BUTTON VALVES. Furthermore, the outlet of the valves of the containers (14) was fitted with a plastics applicator tube of about 180 mm (7 inches) in length and having a bore size of 3.6 mm (large tube) or a bore size of 0.5 mm (0.020 inches) (small tube). These tubes were dipped into the dispensed beer so as to penetrate to a depth of (2.5 mm (1 inch) (Top Dip) into the dispensed beer or alternatively to penetrate to a depth of about 150 mm (6 inches) (Bottom Dip) into the dispensed beer.

As regards TABLE V the dispensed beverage was beer sold under the tradename GUINNESS STOUT poured from a standard 440 ml can into a standard 1 pint glass and the head naturally arising from the dispensing procedure was physically removed so that delivery of the liquid stream was into a beer with no head. The liquid stream and its container (14) was identical to that used in the tests of TABLE III.

It will be understood that the container (14) in each of the tests contained a saturated solution of gas (nitrogen) in the relevant liquid held at elevated pressure and the tests were carried out at near ambient conditions of 20° C. and 14 psig. The absorption co-efficient of the liquids used in the container (14) via BASS DRAUGHT ALE fermented beverage/De-ionised water to nitrogen gas is as follows:

BASS DRAUGHT ALE fermented beverage 0.044
Deionized Water 0.015

TABLE I

| Beer + $N_2$ + COSTER TILT VALVE | | | | |
|---|---|---|---|---|
| Test 1 | large tube | : | Top dip | 5 gm → 6 mm head |
| Test 4 | large tube | : | Bottom Dip | 5 gm → 28 mm head |
| Test 9 | small tube | : | Top dip | 1.4 gm → 28 mm head |
| Test 10 | small tube | : | Bottom Dip | 0.22 gm → 28 mm head |

TABLE II

| Beer + $N_2$ + PERFECT-VALOIS BUTTON VALVE | | | | |
|---|---|---|---|---|
| Test | large tube | : | Top dip | Not tested |
| Test | large tube | : | Bottom Dip | Not tested |
| Test 3 | small tube | : | Top dip | 5 gm → 20 mm head |
| Test 6 | small tube | : | Bottom Dip | 4.5 gm → 20 mm head |

TABLE III

| De-ionised Water + $N_2$ + COSTER TILT VALVE | | | | |
|---|---|---|---|---|
| Test 2 | large tube | : | Top dip | 5 gm → 3 mm head |
| Test 5 | large tube | : | Bottom Dip | 5 gm → 10 mm head |
| Test | small tube | : | Top dip | Not tested |
| Test | small tube | : | Bottom Dip | Not tested |

TABLE IV

| De-ionised water + $N_2$ + PERFECT-VALOIS BUTTON VALVE | | | | |
|---|---|---|---|---|
| | large tube | : | Top dip | Not tested |
| | large tube | : | Bottom Dip | Not tested |
| | small tube | : | Top dip | Not tested |
| Test 7 | small tube | : | Bottom Dip | 5 gm → 6 mm head |

TABLE V

| Beer + $N_2$ + COSTER TILT VALVE | | | | |
|---|---|---|---|---|
| Test | large tube | : | Top dip | Not tested |
| Test | large tube | : | Bottom Dip | Not tested |
| Test 11 | small tube | : | Top dip | 1 gm → 30 mm head |
| Test 12 | small tube | : | Bottom Dip | 0.2 gm → 30 mm head |

In the tests reported in Tables I to V it was not practical to fit the large applicator tube to the PERFECT-VALOS Button Valve (Table II) so that this test was not conducted. Additionally, the results of the remaining tests indicated that some other combinations would not be worth testing as being likely to produce inferior results, for example those indicated in Table IV.

Following from the tests of Tables I–V each of which used only nitrogen gas in the container (14) a further series of tests were conducted using a mixture of nitrogen and carbon dioxide gases. The results indicated that the carbon dioxide gas had little or no discernible effect. Similar results were also achieved using compressed air as the gas indicating that primarily it is nitrogen gas alone which achieves head enhancement and that when this is diluted from 100% by the presence of one or more gases the head enhancement is correspondingly diluted. By way of example, test 9 of Table I was repeated using compressed air as the gas, the result being that 21.5 gm of liquid produced 20 mm of head.

A still further test was conducted as a modification of the test conditions referred to in Tables I–V to confirm the effects of holding the applicator tube above the level of the dispensed beverage. Using the conditions of the Table I tests with the small tube held with its end 150 mm (6 inches) above the dispensed beverage the liquid stream was injected as a jet from above and a 2.5 gm amount of the liquid stream produced a head of 10 mm. This is an acceptable enhancement of the head and taken with the results of Table I demonstrates that acceptable results are achieved whether the liquid stream is injected from above or within the dispensed beverage but best results are achieved by injecting using the 'Bottom Dip' procedure.

A further series of tests were conducted to identify the effect of modifying the conditions of Table II (which used De-ionised water and nitrogen gas in the container) by introduction of 10% IPA (alcohol) to the water. The absorption co-efficient of such a water and alcohol mixture to nitrogen gas is 0.027. In each test the container was fitted with a Coster Tilt Valve and a small diameter (0.020 inch) applicator tube, the dispensed beverage being BASS DRAUGHT ALE fermented beverage as previously. Thus, 1). With the container (14) filled with 90% water and 10% IPA pressurised to 90 psig with compressed air at 20° C., a metered dose of 2 gm of the liquid stream produced a 28 mm Head at Bottom Dip and an 18 mm head at Top Dip.

2. With the container (14) filled with 90% water and 10% IPA pressurised to 100 psig with nitrogen gas, a metered dose of 2.5 gm of the liquid stream produced a 35 mm Head at Bottom Dip and a 25 mm Head at Top Dip.

A final series of tests was conducted to observe the effects when the dispensed beverage was Guinness Stout beer as previously and the liquid stream was injected by Top Dip through a small diameter applicator tube from a container fitted with a Coster Tilt Valve. In this series of tests the container (14) was filled with different liquids and pressurised gases producing the following results:

1) Guinness Stout beer pressurised to 100 psig with nitrogen gas; 1 gm of liquid stream produced in excess of 60 mm Head.

2) Guinness Stout beer pressurised to 90 psig with compressed air at 20° C.; 1 gm of liquid stream produced 40 mm Head.

3) 90% water and 10% IPA pressurised at 100 psig with nitrogen gas; 1.2 gm of liquid stream produced 30 mm Head.

Figure 2:
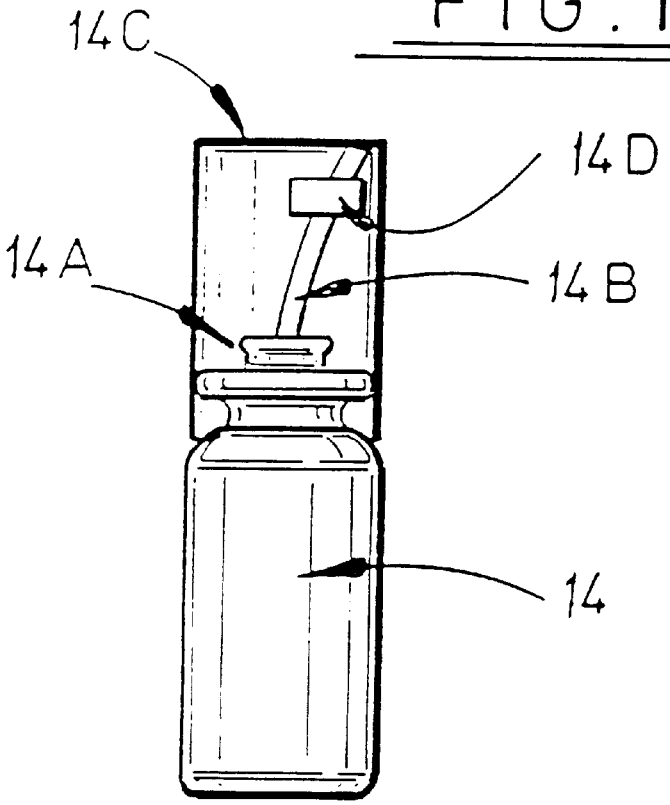
FIGS. 2, 3 and 4 illustrate different arrangements of a FIG. 1 component.
Figure 3:
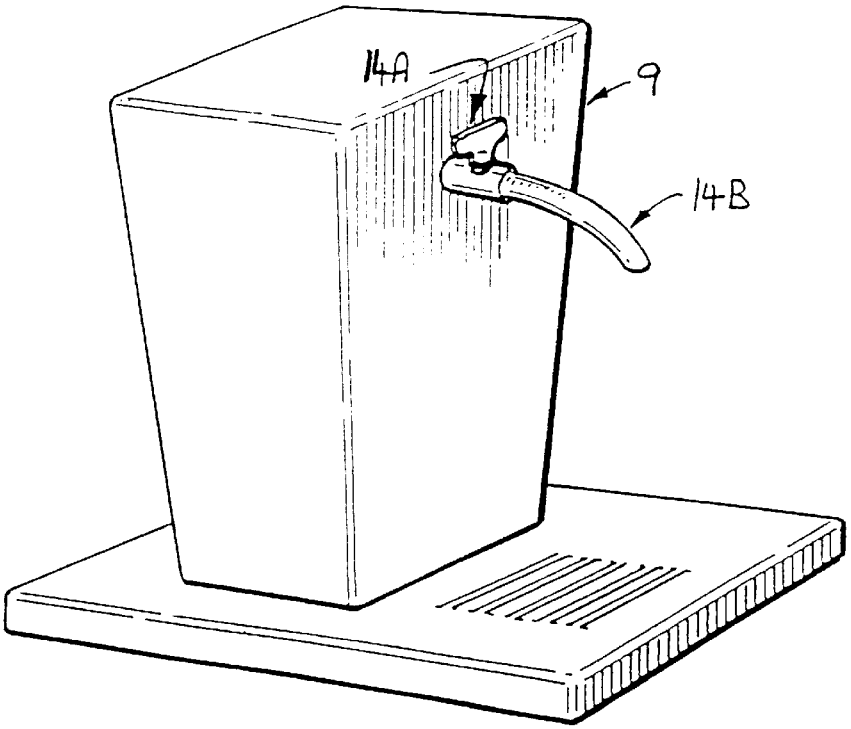
Figure 4:
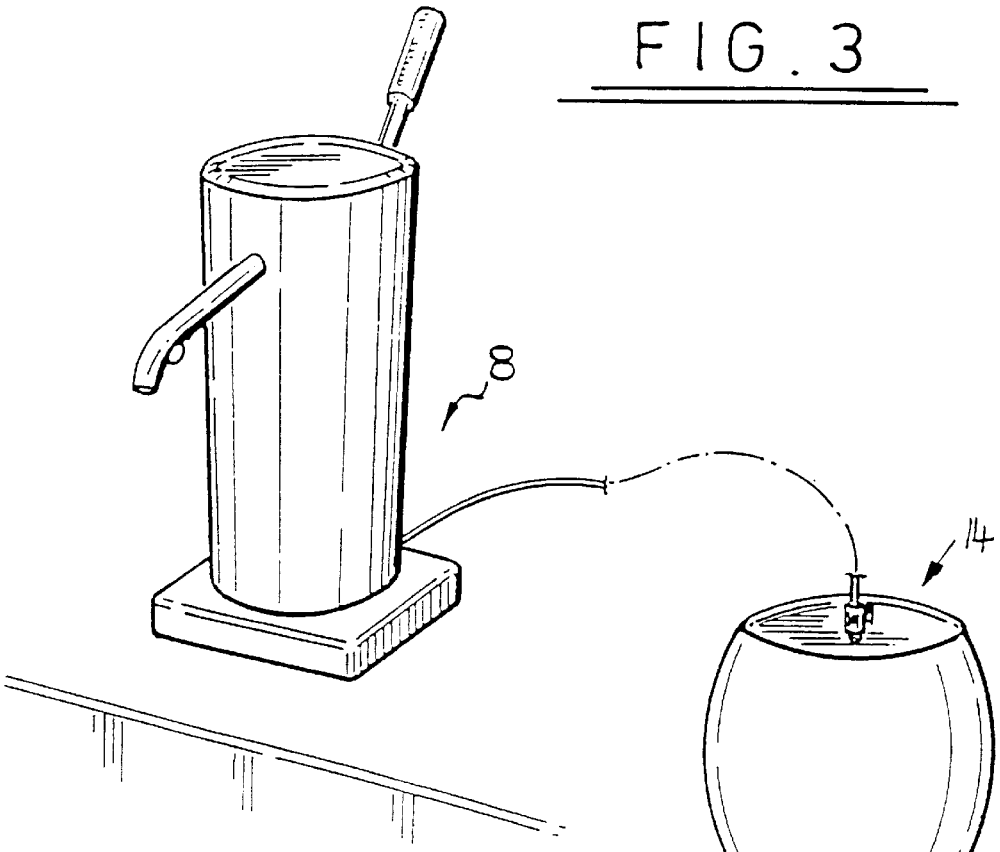

The container 14 may take any one of a number of different forms depending upon whether it is intended for a single use to deliver a single metered dose or for multiple use to deliver a multiplicity of metered does. For example FIG. 2 schematically illustrates a container 14 provided with an applicator tube 14B attached to the outlet of the valve mechanism 14A and hygienically housed within a detachable dust cap 14C. A depth gauge 14D is fitted to the tube 14D to assist the user in dipping the tube 14B to a limited depth into a glass of beer. For the single shot or dose usage the container 14 may take the form of a miniature aerosol container. For multi-shot or multi-dose usage, in addition to a larger volume within the canister it is desirable to use a bicompartmental can wherein the propellant in the outer chamber is maintained at a higher pressure than that of the product thus assuring that the level of gas in the product is maintained so that each shot or dose is delivered at substantially the same pressure. Typically a multi-shot container would be used and sold with a standard pack of 4 or 6 cans of beer. Alternatively it could be used with a special party dispenser plastic housing 9 as shown i FIG. 3 to give the impression of a pseudo-beer-font. For a greater number of meted doses the container could be of similar size to a beer keg or barrel with its output piped to a beer counter location 8 as shown in FIG. 4.

The foregoing liquid stream are also all effective in performing that aspect of the present invention which is concerned with spraying the liquid stream into the drinking vessel prior to the beverage being dispensed thereinto, and provide results very similar to those previously set forth in the various Tables under the category "Bottom Dip".

To perform this aspect of the present invention the pressurised container which holds the liquid and gas to form the liquid stream may be hand-held or counter-mounted and may dispense at any orientation e.g. vertically upwards or downwards since the drinking vessel is empty, and the volume of dispensed liquid stream need only be of the order of 1 ml or so which is dispensed as a spray or mist and therefore adheres to the inner walls of the drinking vessel as a thin film or mist coating. The beverage, e.g. beer, is thereafter dispensed into the vessel.

Figure 5:
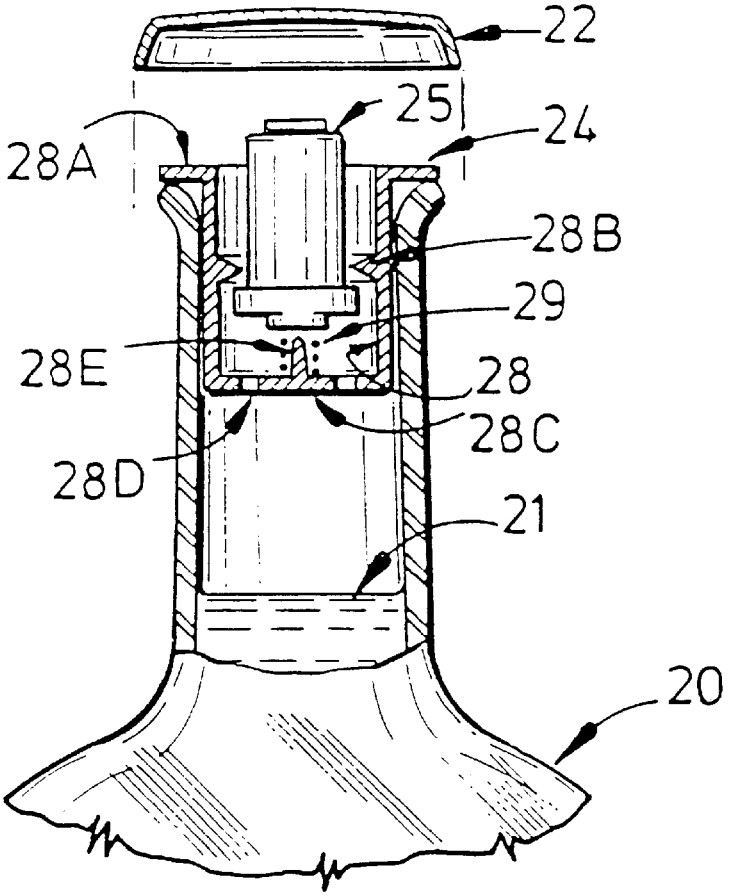
FIGS. 5 and 6 illustrate a further aspect of the present invention.
Figure 6:
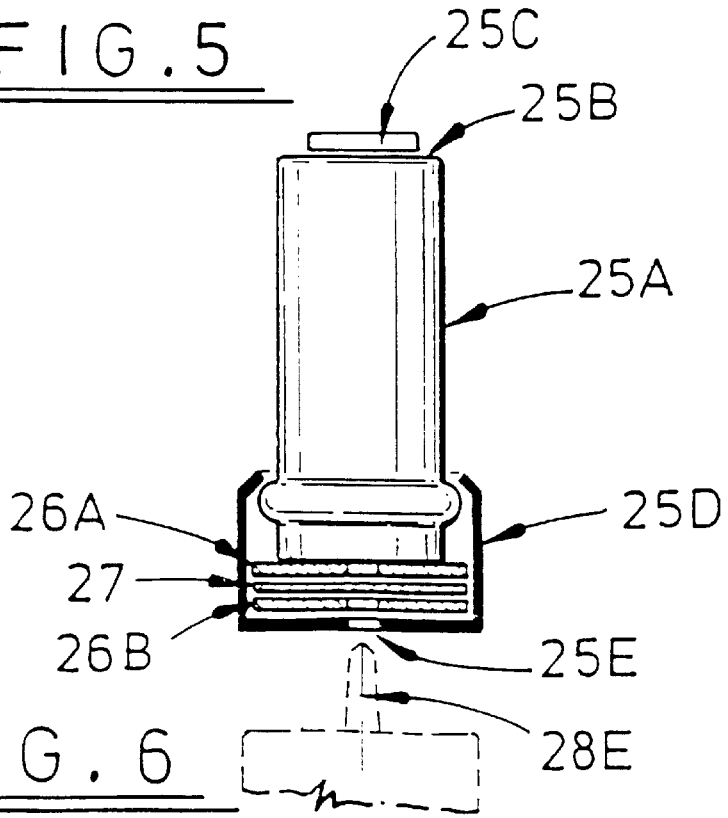

An embodiment of a still further aspect of the present invention is illustrated in FIGS. 5 and 6. Thus, FIG. 5 illustrates a bottle 20 containing a standard volume of beer 21 which typically extends into the neck of the bottle to leave a free head space having a capacity of the order of 25 cc. Conventionally the bottle top is closed by a releasable closure in the form of a crown cork seal 22 but in accordance with one aspect of the present invention an assembly 24, which incorporates a pressurised container 25 is loosely located in the neck of the bottle as will be explained. Container 25 contains a liquid having a gas dissolved therein substantially up to its solubility limit in the liquid at elevated pressure and ambient temperature and is arranged to co-operate with the crown cork seal 22 so that when the seal 22 is removed from the bottle the container 25 automatically dispenses a liquid stream containing a saturated or supersaturated solution of gas dissolved therein, the liquid stream being directed to the interior of the bottle so as to make contact with and form a surface layer on the beer 21.

Container 25 is a modified form of miniaturised aerosol can which, as is best shown in FIG. 6, comprises a main body 25A having a closed end 25B which is provided with an adhesive pad 25C to enable the container 25 to co-operate with the crown cork seal 22. The lower end of the body 25A after having been filled with its gasified liquid is closed by an end cap 25D which in known manner is crimped around a rib formed on the body 25A. Cap 25D houses first and second rubber seals 26A, 26B which each have a central aperture and are located on either side of an imperforate foil closure membrane 27. End cap 25D is also provided with a central aperture 25E which is aligned with the apertures in the seals 26A, 26B.

After bottle 20 has been filled with the predetermined quantity of beer 21 the assembly 24 is loosely fitted to the bottle in the condition illustrated in FIG. 5. The fully charged container 25 is carried by a plastic carrier 28 having a flange 28A which rests on the free end of the bottle. The body of carrier 28 is generally cylindrical and contains an annular inwardly projecting rib 28B which prevents the container 25 being readily removed from the assembly 24 because the diameter of the cap 25D is greater than that of the rib 28B. At the opposite end of carrier 28 from flange 28A the carrier has a floor portion 28C which contains a number of apertures 28D and an upwardly directed finger-like piercing member 28E which is centrally disposed on the floor portion 28C so as to be aligned with aperture 25E in the container cap 25D. Finger member 28E is surrounded by a coil spring 29. It will be appreciated that in the FIG. 5 condition the finger member 28E is spaced from the foil membrane 27 because the spring 29 is uncompressed and engages the cap 25D.

The crown cork seal 22 is subsequently applied in standard manner so as to be forced onto the top of the bottle 20 and be circumferentially crimped around the bottle top to provide for an effective seal. This action causes the crown cork seal 22 to become adhered to the container 25 due to the adhesive pad 25C and additionally the entire container 25 is forced downwardly into the bottle 20 such that the finger member 28E extends into the container 25 and pierces the foil closure membrane 27 but is circumferentially sealed by the two rubber seals 26A, 26B so that there is no escape of the container contents in this operation. Subsequently, when a person wishing to consume the beer 21 within the bottle 20 removes the crown cork seal 22 in the standard manner the levering of the crown seal 22 from the top of the bottle 20 causes the container 25 to be raised from its previous position by the spring 29 such that the finger member 28E is released from the container 25 and the contents thereof are immediately expelled through the pierced membrane 27 and through the apertures 28D in the floor of the carrier 28 to form a released liquid stream which is directed towards the interior of the bottle and the upper surface of the beverage contained therein. Continued action to remove the crown cork seal 22 causes the container 25 to be removed completely from the bottle 20 and the carrier 28 is additionally dragged out of the bottle neck under the cooperative action of the rib 28B and the cap 25D. The contents of the bottle 20 are then dispensed into a drinking vessel where the liquid stream co-operates with the gas content of the beverage in a form of seeding effect to achieve an enhanced foam head in the drinking vessel which arises due to depletion of the gas content of the beverage.

The container 25 conveniently has a volume of less than 10 cc and is charged with any one of the specific liquid and gas combinations previously described which typically have a density about 1% less than that of the beer 21. Accordingly, there is a differential density which enables the liquid stream which emerges from the container 25 to float on the top surface of the beer 21 when the beer is in the bottle 20 and enables that liquid stream to flow with the beer 21 into the drinking vessel when the beer is dispensed thereinto so that the seeding effect previously referred to occurs in the drinking vessel by virtue of the pouring action causing the thin surface film of liquid stream to become mixed within the body of the dispensed beer in the drinking vessel.

I claim:

1. A bottle of potable beverage having a bottle top, the bottle top being sealed by a releasable closure, wherein the improvement is the provision of a pressurized container containing a liquid having a gas dissolved therein substantially up to its solubility limit in the liquid at elevated pressure, which container is fitted within a neck provided in the bottle and is adapted on release of the releasable closure automatically to release its contents as a liquid stream containing a saturated solution of dissolved gas therein, the released liquid stream being directed towards an upper surface of the beverage contained therein.

2. A bottle of potable beverage as claimed in claim 1, wherein the bottle is pressurized and contains a beverage containing a gas in solution and the contents of the pressurized container are held at a pressure level elevated with respect to that of the bottle, such that the released liquid stream co-operates with the gas content of the beverage in a form of seeding effect to achieve an enhanced foam head without major depletion of the gas content of the beverage.

3. An assembly capable of being located in the neck of a bottle, the assembly comprising a pressurized container mounted in a carrier, the carrier having a retention member for supporting the assembly in the neck of the bottle and a downwardly directed aperture, the carrier having an upwardly-directed piercing member, the container containing a pressurized liquid and dissolved gas and comprising a main body having a rupturable wall portion adjacent the piercing member, the container being movable relative to the carrier to allow the piercing member to pierce the rupturable wall portion and retract therefrom such that, in use, when the piercing member retracts therefrom a liquid stream containing the gas in saturated solution is released from the container.

4. An assembly capable of being located in the neck of a bottle, the assembly comprising a pressurized container mounted in a carrier, the carrier having a body extending from a flange for supporting the assembly on a bottle top provided on the bottle to an apertured floor having an upwardly-directed piercing member, the container being charged with pressurized liquid and dissolved gas and comprising a main body having an end adjacent the piercing member comprising a rupturable membrane and an annular gasket, wherein resilient means initially hold the container in the carrier with the membrane spaced from the piercing member but, in use, when the carrier is supported the container is capable of being forced towards the floor by providing a force on the container causing the piercing member to pierce the membrane and seal with the gasket to prevent escape of the container contents until such time as the force on the container is released and when the force is released a liquid stream containing the gas in saturated solution is released from the container.

* * * * *